US006521093B2

(12) United States Patent
Meschenmoser

(10) Patent No.: US 6,521,093 B2
(45) Date of Patent: Feb. 18, 2003

(54) PRESS ARRANGEMENT

(75) Inventor: Andreas Meschenmoser, Horgenzell (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/965,799

(22) Filed: Oct. 1, 2001

(65) Prior Publication Data

US 2002/0050330 A1 May 2, 2002

(30) Foreign Application Priority Data

Oct. 31, 2000 (DE) ..... 100 53 935

(51) Int. Cl.[7] ..... D21F 3/04
(52) U.S. Cl. ..... 162/306; 162/360.2; 162/358.3
(58) Field of Search ..... 162/205, 358.3, 162/360.2, 305, 306

(56) References Cited

U.S. PATENT DOCUMENTS

| | | | | |
|---|---|---|---|---|
| 4,110,156 A | | 8/1978 | Stotz et al. | 162/305 |
| 5,124,000 A | | 6/1992 | Stenvall | 162/205 |
| 5,308,450 A | | 5/1994 | Braun et al. | 162/360.2 |
| 5,431,787 A | | 7/1995 | Braun et al. | 162/360.3 |
| 6,090,244 A | * | 7/2000 | Kotitchke | 162/360.2 |
| 6,334,932 B1 | * | 1/2002 | Meschenmoser | 162/360.2 |

FOREIGN PATENT DOCUMENTS

| | | |
|---|---|---|
| DE | 3942396 | 6/1990 |
| DE | 19921205 | 3/2000 |
| DE | 19902139 | 7/2000 |
| DE | 19912497 | 9/2000 |
| EP | 0795642 | 9/1997 |
| EP | 0985764 | 3/2000 |
| EP | 1101861 | 5/2001 |

* cited by examiner

*Primary Examiner*—Karen M. Hastings
(74) *Attorney, Agent, or Firm*—Greenblum & Bernstein, P.L.C.

(57) ABSTRACT

Press arrangement for processing a fibrous material web that includes at least first and second presses arranged to form at least first and second press nips. The at least first and second presses are consecutively arranged without intervening presses, and structured and arranged without a common center roll and without a common felt. The first press is a double felted press including a suction press roll and a mating roll, and is positioned upstream from the second press relative to a web run direction. The suction press roll is structured and arranged as a pick-up roll and is located on top of said mating roll.

31 Claims, 2 Drawing Sheets

PRESS ARRANGEMENT

CROSS-REFERENCE TO RELATED APPLICATIONS

The present application claims priority under 35 U.S.C. §119 of German Patent Application No. 100 53 935.1, filed Oct. 31, 2000, the disclosure of which is expressly incorporated by reference herein in its entirety.

BACKGROUND OF THE INVENTION

1. Field of the Invention

The invention relates to a press arrangement for processing a fibrous material web, in particular a paper or cardboard web.

2. Discussion of Background Information

Tandem-NipcoFlex-presses known up to now have been proven in operation. However, they are comparatively expensive and have a relatively long structural length. Additionally, when heavy paper types are used, a web tear can occur downstream of the pick-up roll.

SUMMARY OF THE INVENTION

The present invention provides an improved press arrangement in which the above-mentioned problems are eliminated. In particular, a compact structure is to be achieved in addition to a web guidance that is as continuous as possible downstream of the wire.

Accordingly, a press arrangement is provided for processing a fibrous material web, in particular a paper or cardboard web, having at least two press nips formed by two separate presses without a common center roll, in which the first roll, viewed in the web travel direction, is double-felted, and includes a suction press roll positioned on top, simultaneously embodied as a pick-up roll, as well as a mating roll positioned at the bottom.

Due to this design, an overall compact, inexpensive construction results which is particularly advantageous for modifications. Although press arrangements having a suction press roll assigned to a first roll and simultaneously serving as a pick-up roll are known from DE-A-199 02 139 and DE-A-199 12 497, in these known press arrangements the first and second roll, have a common center roll and/or at least one common felt.

A web tear downstream of the pick-up is avoided, even in the case of heavy papers, because a completely continuous web guidance is provided in the region downstream of the wire with the solution according to the invention. This solution results in an inexpensive double-felt press concept, in particular for even-sided paper.

Since the suction press roll is simultaneously provided as a pick-up roll, the fibrous material web can be accepted by a wire belt of the wire section via the upper felt guided over these suction press rolls.

In an exemplary embodiment of the press arrangement according to the invention, the mating roll allocated to the suction press roll is a sagging compensation roll or a crown bow compensation roll.

Here, this mating roll allocated to the suction press roll can be, in particular, a so called Nipco-F roll, i.e., a self loading roll.

The second roll, viewed in the web travel direction, is preferably a shoe press.

The second roll, viewed in the web travel direction, can preferably be double-felted.

In a practical embodiment of the press arrangement according to the invention, the press plane running through the second press nip is tilted in relation to the vertical.

Preferably, separate felts are guided through the first press nip and through the second press nip. Thus, it is advantageous not to provide a felt that is simultaneously guided through both press nips.

Generally, for example, it is also possible for an upper felt and a lower continuous belt, in particular a press belt, to be guided through the second press nip, viewed in the web travel direction. Here as well, the upper felt and the lower press belt are preferably guided through the second press nip only, i.e., not through the first press nip as well.

It is practical for the suction press roll to be blind bored and/or grooved in order to allow at least a partial dewatering by means of spinning off water.

Here, a gutter or collector is preferably allocated to the suction press roll that collects the water spun off the suction press roll. With the aid of the suction press roll positioned on top, the spun off water can be slowed down to some extent, allowing it to collect in a gutter or collector.

A practical embodiment of the press arrangement according to the invention is distinguished by the fact that, in the region of the transfer point, the upper felt, guided through the second press nip, is guided around a deflection roll, preferably embodied as a suction roll. It is practical for the upper felt, guided through the second press nip, to be guided around a deflection roll, preferably embodied as a suction roll, in the region of the transfer point.

In a useful practical embodiment, the fibrous material web is accepted by an upper felt guided through the second press nip in a region between the deflection roll, allocated to the lower felt of the first press, and another deflection roll allocated to this lower felt.

The press plane through the first press nip is advantageously tilted relative to the vertical.

The suction press roll is preferably driven. Additionally or alternatively, the mating roll allocated to this suction press roll can be driven as well.

In a preferred practical embodiment of the press arrangement according to the invention, the second press provided as a shoe press includes a shoe press roll positioned on top and a mating roll positioned at the bottom. Here, the mating roll is preferably driven.

Another advantageous embodiment of the press arrangement according to the invention is distinguished by the fact that the second press, viewed in the web travel direction, is single-felted, that the roll positioned at the bottom of the second press contacts the fibrous material web, and that at least one doctor is allocated to the roll positioned at the bottom.

The present invention is directed to a press arrangement for processing a fibrous material web that includes at least first and second presses arranged to form at least first and second press nips. The at least first and second presses are structured and arranged without a common center roll and without a common felt. The first press is a double felted press including a suction press roll and a mating roll, and is positioned upstream from the second press relative to a web run direction. The suction press roll is structured and arranged as a pick-up roll and is located on top of said mating roll.

Further, the material web can be a paper or a cardboard web. Also, the double felted press can include at least first and second felts arranged to sandwich the material web in said first press nip.

According to a feature of the invention, the arrangement further includes an upper felt guided around the suction press roll, which may be arranged to accept the material web from an upstream section of a web production machine. The upper felt can be arranged to accept the material web from a wire belt.

The mating roll can include a sagging compensation roll. Additionally, or alternatively, the mating roll may include a self-loading roll.

Further, the second press may include a shoe press. Additionally, or alternatively, the second press can be a second double felted press. The second double felted press may include at least first and second felts arranged to sandwich the material web in the press nip. Moreover, the double felted press may include at least first and second felts arranged to sandwich the material web in the first press nip, and the second double felted press comprises at least third and fourth felts arranged to sandwich the material web in the second press nip.

In accordance with another feature of the present invention, the second press may be arranged such that a press plane through the second press nip is oriented obliquely to vertical.

The press arrangement may further include an upper felt and a lower continuous belt guided through the second press nip. Further, the lower continuous belt can be a press belt. The upper felt and the lower continuous belt may be guided through the second press nip, but not through the first press nip.

According to a further feature of the instant invention, the suction press roll may include at least one of a blind bored and grooved surface. A gutter can be positioned in a region of the suction press roll to collect water spun off of the suction press roll.

Moreover, the press arrangement may include a deflection roll positioned between the first press and the second press. A lower felt of the first press can be arranged to guide the material web over the deflection roll and an upper felt of the first press may be separated from the material web and the lower felt in a region of the deflection roll. An upper felt of the second press can be arranged to accept the material web from the lower felt of the first press at a transfer point in a vicinity of the deflection roll. Further, the deflection roll may include a suction roll, the region of the deflection roll is upstream of the deflection roll, and the transfer point can be downstream of the deflection roll. Still further, a second deflection roll can be provided, around which the upper felt of the second press may be guided in a region of the transfer point. Another deflection roll can be provided around which the lower felt of the first press is guided, the another deflection roll may be located downstream from the deflection roll. The upper felt of the second press may be arranged to accept the material web from the lower felt of the first press in a region between the deflection roll and the another deflection roll.

According to a still further feature of the invention, the first press can be positioned such that a press plane through the first press nip is oriented obliquely with respect to vertical.

Further, the suction press roll can be a driven roll. Additionally, or alternatively, the mating roll may be a driven roll.

According to another feature of the present invention, the second press can include a shoe press roll and a mating roll. The shoe press roll can be positioned on top of the mating roll.

In accordance with yet another feature of the present invention, the second press can be a single-felted press. The single-felted press may include a roll having a surface arranged to directly contact the material web. The single-felted press can further include at least one doctor arranged against the roll surface. Moreover, the single-felted press may further include a shoe press roll positioned above the roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
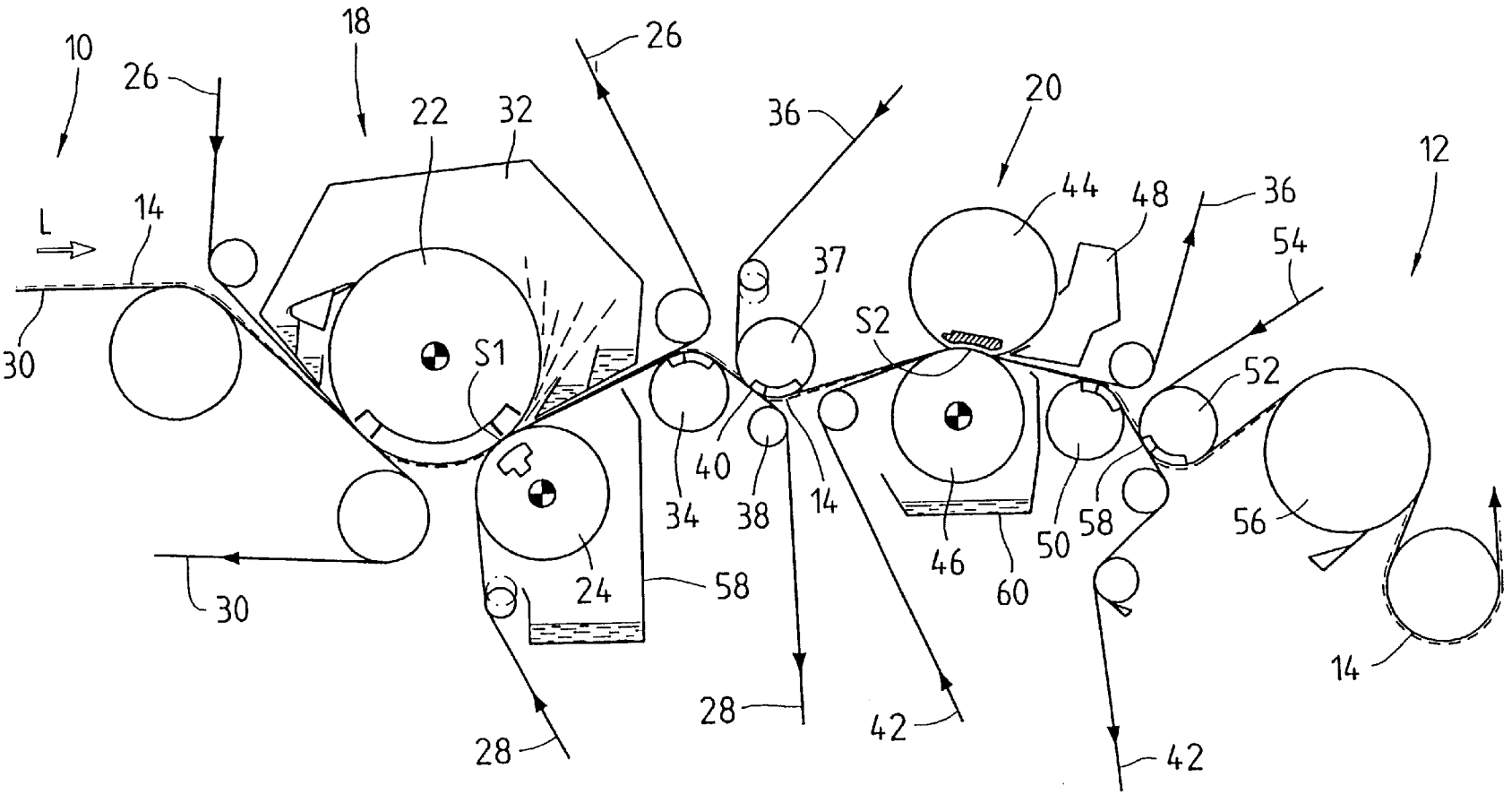
FIG. 1 a schematic depiction of a first embodiment of a press arrangement having two double-felted presses each, and FIG. 2 a schematic depiction of another embodiment of the press arrangement having one single felted press and one double felted press.

FIG. 1 shows, in a purely schematic depiction, a first embodiment of a press section, arranged between a wire section 10 and a drying section 12, of a machine for producing a fibrous material web 14, in particular a paper or a cardboard web.

The press section provided between the wire section 10 and the drying section 12 includes a double press arrangement 16 having two press nips S1 and S2 positioned one after the other in the web travel direction L, which are formed by two separate presses 18, 20 without any common center roll or common felts.

The first press 18, viewed in the web travel direction L, includes a suction press roll 22, simultaneously embodied as a pick-up roll, and positioned on the top, and a mating roll 24 positioned at the bottom.

An upper felt 26 and a lower felt 28, between which the fibrous material web 14 is guided through the press nip S1 of the press 18, are allocated to this first press 18.

As is discernible from FIG. 1, the upper felt 26, guided around the suction press roll 22, accepts the fibrous material web 14 from a wire belt 30 of the wire section 10.

The mating roll 24 allocated to the suction press roll 22 can, in particular, be embodied as a sagging (or deflection) compensation roll. This mating roll 24 can be embodied by a so-called Nipco-F-roll, i.e., a self-loading roll.

The suction press roll 22 can be blind bored and/or grooved in order to allow at least a partial dewatering by spinning off water. In the present case, a gutter or collector 32 is allocated to a suction press roll 22, which accepts the water spun off of the suction press roll 22.

The suction press roll 22 and the mating roll 24 allocated thereto are both driven.

As is discernible from FIG. 1, the suction press roll 22 is arranged diagonally to the left above the mating roll 24 allocated thereto. The press plane through the first press nip S1 is tilted with respect to the vertical as well.

The fibrous material web 14 guided out of the first press nip S1 together with the upper felt 26 and the lower felt 28 is separated from the upper felt 26 in the region of a deflection roll 34, preferably embodied as a suction roll, and is guided together with the lower felt 28 around the deflection roll 34, in which region they are subsequently accepted by an upper felt 36, guided through a second press nip S2. In the present case, the fibrous material web 14 is accepted by an upper felt 36 guided through the second press nip S2 in a region between the deflection roll 34 allocated to the lower felt 28 of the first press 18 and another deflection roll 38 allocated to this lower felt 28. The upper felt 36 guided through the second press nip S2 is guided around a deflection roll 37, preferably embodied as a suction roll as well, in the region of the transfer point 40.

In addition to the upper felt 36, a lower felt 42 is allocated to the press 20, for example. This second press 20 may be double felted as well. Alternatively, a continuous belt can also be provided, such as, in particular, a press belt or the like, instead of a lower felt 42.

As is discernible from FIG. 1, the second press 20, viewed in the web travel direction L, is a shoe press in the present case, having a shoe press roll 44 positioned at the top and a mating roll 46, preferably driven, positioned at the bottom.

In the present case, the shoe press roll 44 is positioned diagonally on the right above the mating roll 46. The press plane through the second press nip S2 is again tilted relative to the vertical.

The upper felt 36 and the lower felt 42 and/or the respective lower continuous belt, e.g., a press belt as well, are guided through the second press nip S2 only, i.e., not through the first press nip S1 as well. Thus, separate felts and/or separate continuous belts travel through the first press nip S1 and through the second press nip S2.

The roll jacket of the shoe press roll 44 can be blind bored and/or grooved in order to at least partially allow another dewatering by means of spinning off water. Correspondingly, a gutter or collector 48 is allocated to this roll 44 as well in order to collect the water spun off of the roll 44.

As is discernible from FIG. 1, in the present exemplary embodiment, at least one gutter or collector 58 or 60 each is allocated to the roll 24 positioned at the bottom and to the roll 46 positioned at the bottom.

Subsequent to the second press nip S2, the fibrous material web 14 is guided together with the lower felt 42 around the deflection roll 50, preferably embodied as a suctioned roll, in whose region the upper felt 36 is separated from the fibrous material web 14 and the lower felt 42.

Subsequently, the fibrous material web 14 is accepted by a dry wire 54 in the region of a deflection roll 52 embodied as a suction roll, and is guided to the first drying cylinder 56 of the drying section 12.

Figure 2:
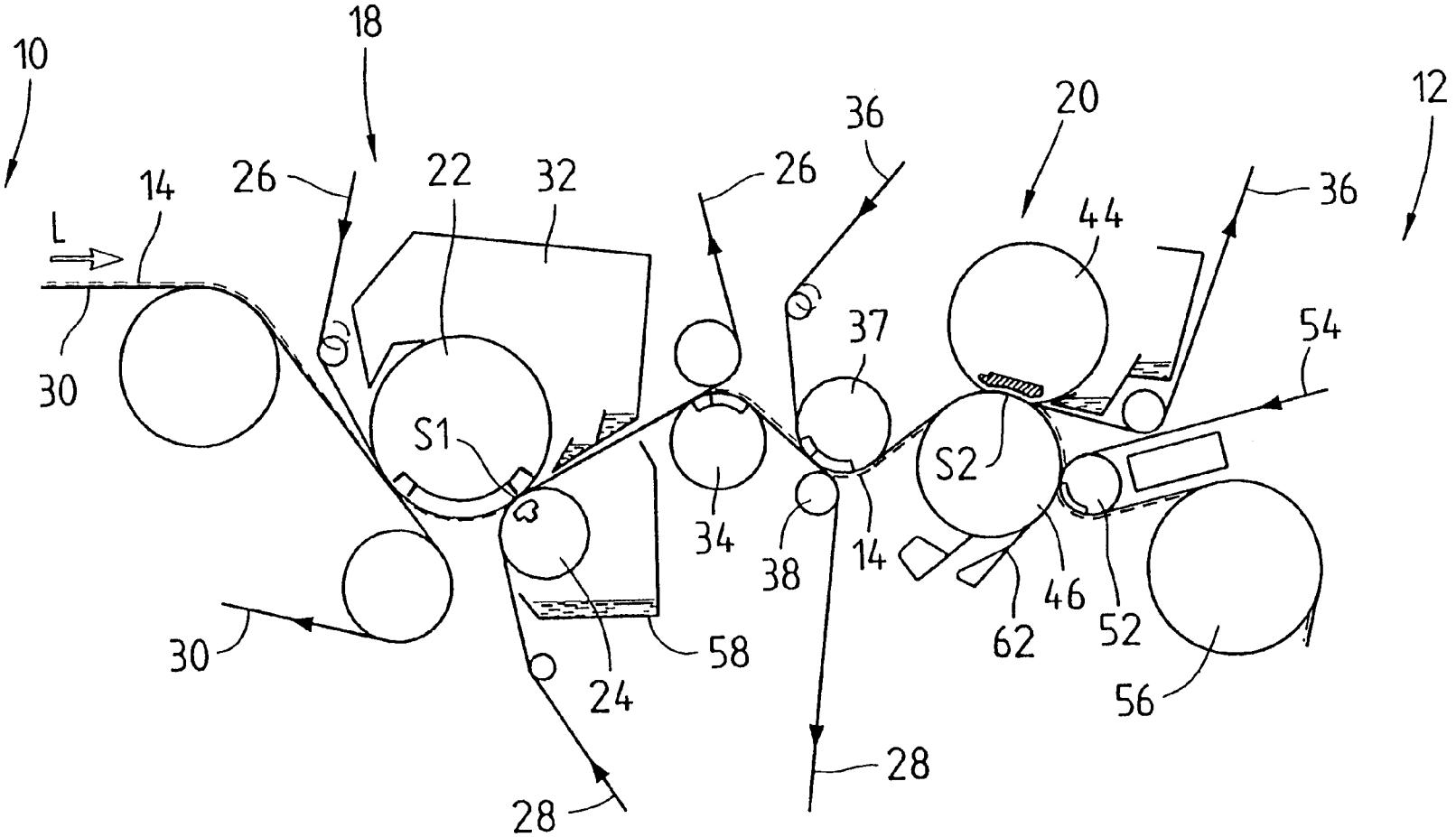

In a purely schematic depiction, FIG. 2 shows another embodiment of a press section arranged between a wire section 10 and a drying section 12 of a machine for producing a fibrous material web 14. In this case as well, the fibrous material web 14 may be a paper or cardboard web.

Again, the press section comprises a double press arrangement 16 having two press nips S1 and S2 arranged subsequent to one another in the web travel direction L, formed by two separate presses 18, 20 without any common center roll or any common felts.

The present press section differs from that of FIG. 1 primarily in that the second press 20, viewed in the web travel direction L, is not double-felted, but rather single-felted and in that the roll 46 of this second press 20, positioned at the bottom, contacts the fibrous material web 14 and at least one doctor 62 is allocated to the roll 46 positioned at the bottom.

Subsequent to the second press nip S2, the fibrous material web 14, separated from the upper felt 36, travels a certain distance on the roll 46 positioned at the bottom, from which it is accepted, for example, by a drying wire 54 and is guided back to the first drying cylinder 56 of the drying section 12. At the transfer point, the drying wire 54 can also be guided over a deflection roll 52, particularly embodied as a suction roll.

In general, this embodiment can have essentially the same design as that of FIG. 1. Corresponding parts have been given the same reference characters.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 wire section
12 drying section
14 fibrous material web
16 press arrangement
18 first press
20 second press
22 suction press roll
24 mating roll
26 upper felt
28 lower felt
30 wire belt
32 gutter or collector
34 deflection roll
36 upper felt
37 deflection roll
38 deflection roll
40 transfer point
42 lower felt
44 shoe press roll
46 mating roll
48 gutter or collector

50 deflection roll
52 deflection roll
54 drying wire
56 drying cylinder
58 gutter or collector
60 gutter or collector
62 doctor
L web travel direction
S1 press nip
S2 press nip

What is claimed:

1. A press arrangement for processing a fibrous material web comprising:

at least first and second presses consecutively arranged without intervening presses to form at least first and second press nips, wherein said at least first and second presses are structured and arranged without a common center roll and without a common felt;

said first press being a double felted press comprising a suction press roll and a mating roll, and being positioned upstream from said second press relative to a web run direction, wherein said suction press roll is structured and arranged as a pick-up roll and is located on top of said mating roll.

2. The press arrangement in accordance with claim 1, wherein the material web comprises a paper or a cardboard web.

3. The press arrangement in accordance with claim 1, wherein said double felted press comprises at least first and second felts arranged to sandwich the material web in said first press nip.

4. The press arrangement in accordance with claim 1, further comprising an upper felt guided around said suction press roll, which is arranged to accept the material web from an upstream section of a web production machine.

5. The press arrangement in accordance with claim 4, wherein said upper felt is arranged to accept the material web from a wire belt.

6. The press arrangement in accordance with claim 1, wherein said mating roll comprises a sagging compensation roll.

7. The press arrangement in accordance with claim 1, wherein said mating roll comprises a self-loading roll.

8. The press arrangement in accordance with claim 1, wherein said second press comprises a shoe press.

9. The press arrangement in accordance with claim 1, wherein said second press is a second double felted press.

10. The press arrangement in accordance with claim 9, wherein said second double felted press comprises at least first and second felts arranged to sandwich the material web in said press nip.

11. The press arrangement in accordance with claim 9, wherein said double felted press comprises at least first and second felts arranged to sandwich the material web in said first press nip, and said second double felted press comprises at least third and fourth felts arranged to sandwich the material web in said second press nip.

12. The press arrangement in accordance with claim 1, wherein said second press is arranged such that a press plane through said second press nip is oriented obliquely to vertical.

13. The press arrangement in accordance with claim 1, further comprising an upper felt and a lower continuous belt guided through said second press nip.

14. The press arrangement in accordance with claim 13, wherein said lower continuous belt comprises a press belt.

15. The press arrangement in accordance with claim 13, wherein said upper felt and said lower continuous belt are guided through said second press nip, but not through said first press nip.

16. The press arrangement in accordance with claim 1, wherein said suction press roll comprises at least one of a blind bored and grooved surface.

17. The press arrangement in accordance with claim 16, wherein a gutter is positioned in a region of said suction press roll to collect water spun off of said suction press roll.

18. The press arrangement in accordance with claim 1, further comprising a deflection roll positioned between said first press and said second press, wherein a lower felt of said first press is arranged to guide the material web over said deflection roll and an upper felt of said first press is separated from the material web and said lower felt in a region of said deflection roll.

19. The press arrangement in accordance with claim 18, wherein an upper felt of said second press is arranged to accept the material web from said lower felt of said first press at a transfer point in a vicinity of said deflection roll.

20. The press arrangement in accordance with claim 19, wherein said deflection roll comprises a suction roll, said region of said deflection roll is upstream of said deflection roll, and said transfer point is downstream of said deflection roll.

21. The press arrangement in accordance with claim 19, further comprising a second deflection roll around which said upper felt of said second press is guided in a region of said transfer point.

22. The press arrangement in accordance with claim 19, further comprising another deflection roll around which said lower felt of said first press is guided, said another deflection roll being located downstream from said deflection roll, wherein said upper felt of said second press is arranged to accept the material web from said lower felt of said first press in a region between said deflection roll and said another deflection roll.

23. The press arrangement in accordance with claim 1, wherein said first press is positioned such that a press plane through said first press nip is oriented obliquely with respect to vertical.

24. The press arrangement in accordance with claim 1, wherein said suction press roll is a driven roll.

25. The press arrangement in accordance with claim 24, wherein said mating roll is a driven roll.

26. The press arrangement in accordance with claim 1, wherein said second press comprises a shoe press roll and a mating roll, wherein said shoe press roll is positioned on top of said mating roll.

27. The press arrangement in accordance with claim 1, wherein said mating roll is a driven roll.

28. The press arrangement in accordance with claim 1, wherein said second press is a single-felted press.

29. The press arrangement in accordance with claim 28, wherein said single-felted press comprises a roll having a surface arranged to directly contact the material web.

30. The press arrangement in accordance with claim 29, wherein said single-felted press further comprises at least one doctor arranged against said roll surface.

31. The press arrangement in accordance with claim 28, wherein said single-felted press further comprises a shoe press roll positioned above said roll.

* * * * *